US011619103B2

(12) United States Patent
Ramos et al.

(10) Patent No.: US 11,619,103 B2
(45) Date of Patent: Apr. 4, 2023

(54) VIRTUAL ASSISTED MAKEUP

(71) Applicant: The Charles Machine Works, Inc., Perry, OK (US)

(72) Inventors: Pete Ramos, Enid, OK (US); Aleksander S. Wolfe, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 545 days.

(21) Appl. No.: 16/735,871

(22) Filed: Jan. 7, 2020

(65) Prior Publication Data

US 2020/0217151 A1 Jul. 9, 2020

Related U.S. Application Data

(60) Provisional application No. 62/789,174, filed on Jan. 7, 2019.

(51) Int. Cl.
*E21B 19/16* (2006.01)

(52) U.S. Cl.
CPC ..... *E21B 19/161* (2013.01); *E21B 19/165* (2013.01)

(58) Field of Classification Search
CPC .... E21B 19/161; E21B 19/162; E21B 19/163; E21B 19/164; E21B 19/165
See application file for complete search history.

(56) References Cited

U.S. PATENT DOCUMENTS

| | | | | |
|---|---|---|---|---|
| 6,637,522 | B2 | 10/2003 | Wilson et al. | |
| 6,651,755 | B1 | 11/2003 | Kelpe | |
| 6,766,869 | B2 | 7/2004 | Brand et al. | |
| 7,011,166 | B2 | 3/2006 | Koch et al. | |
| 8,136,612 | B2 | 3/2012 | Carlson et al. | |
| 2005/0029016 | A1* | 2/2005 | Self | E21B 7/046 175/74 |
| 2008/0110674 | A1 | 5/2008 | Jones et al. | |
| 2008/0185185 | A1* | 8/2008 | Mitchell | E21B 7/046 175/27 |
| 2017/0342816 | A1 | 11/2017 | LaValley et al. | |
| 2019/0277099 | A1 | 9/2019 | Slaughter, Jr. et al. | |

FOREIGN PATENT DOCUMENTS

| | | |
|---|---|---|
| WO | 1997049895 | 12/1997 |
| WO | 2006108918 A1 | 10/2006 |

* cited by examiner

*Primary Examiner* — Kristyn A Hall
(74) *Attorney, Agent, or Firm* — Tomlinson McKinstry, P.C.

(57) ABSTRACT

A method of handling pipe segments during makeup and breakout of a drill string. The method uses a hydraulic circuit, which provides fluid to a motor or motors for translating a drill pipe segment. The drill pipe segment is supported by a carriage, which places the segment next to a drill string for addition thereto. Hydraulic pressure within the circuit is monitored to determine if a pressure fluctuation exists. If so, the translation speed is adjusted by modifying the hydraulic fluid flow to the motors. Sensors may be utilized to determine whether or not the system is in a "transition zone" and therefore ready for pressure monitoring for makeup and breakout functions.

18 Claims, 10 Drawing Sheets

VIRTUAL ASSISTED MAKEUP

SUMMARY

The present invention is directed to a method for attaching a threaded pipe segment to a drill string. The method comprises using at least one motor powered by a hydraulic circuit to apply thrust to the threaded pipe segment in the direction of the drill string and placing the circuit into a transition mode. The transition mode is characterized by monitoring pressure in the hydraulic circuit and automatically altering the flow rate of fluid within the circuit in response to a change in the monitored circuit pressure.

In another aspect, the invention is directed to a method of handling first and second elongate objects. The first object has a first end. The second object has a second end with a shape complementary to the first end of the first object. The method comprises rotating a first object relative to the second object and using at least one motor powered by a hydraulic circuit to move the first object towards the second object. As the first object moves longitudinally toward the second object, pressure is monitored within the hydraulic circuit. The rate of fluid flow is adjusted within the circuit in response to a change in the monitored hydraulic pressure.

In another aspect the invention is directed to a method. The method comprises providing hydraulic fluid to a motor via a hydraulic circuit, powering longitudinal movement of a tubular pipe segment with the motor, monitoring the pressure of the hydraulic fluid within the hydraulic circuit, rotating the tubular pipe segment, and adjusting a rate of flow of hydraulic fluid to the motor when the monitored pressure meets or exceeds a predetermined threshold.

In another embodiment the invention is directed to a method of using a system. The system comprises a tubular pipe segment, a motor, and a hydraulic circuit. The motor is configured to power either translational or rotational movement of the pipe segment. The motor is disposed within the hydraulic circuit, and fluid flows within the hydraulic circuit. The method comprises causing fluid to flow around the hydraulic circuit and through the motor, and monitoring the hydraulic circuit for a pressure differential between opposite sides of the motor. In response to a pressure differential, the flow rate of fluid within the hydraulic circuit is automatically adjusted.

DESCRIPTION

Figure 8:
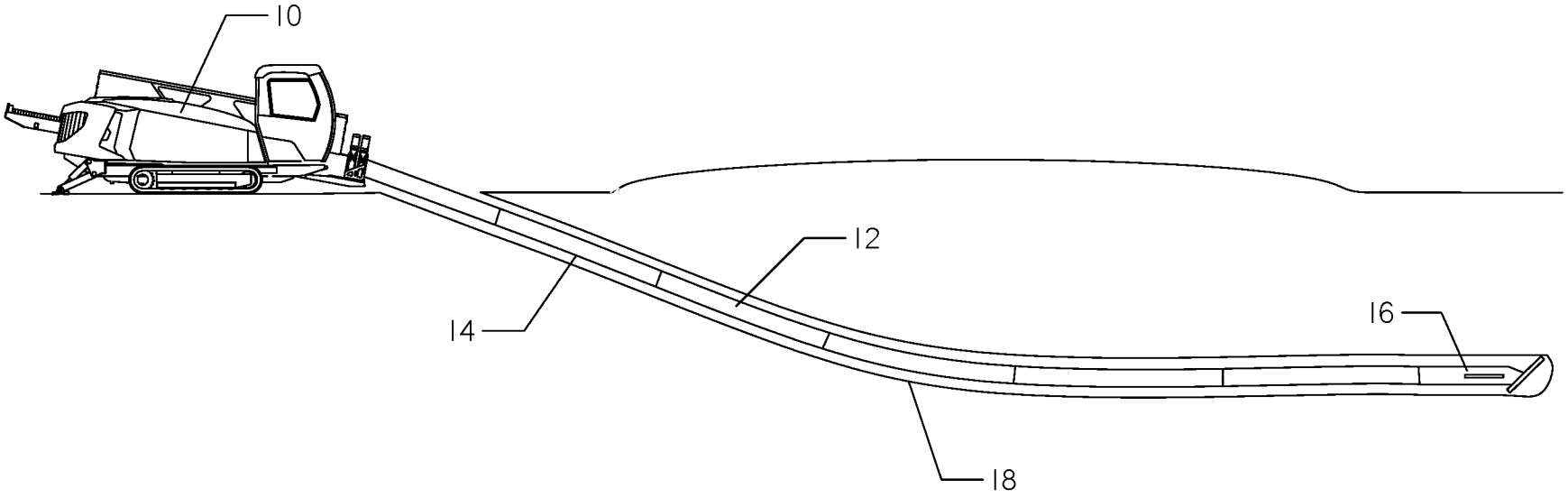
FIG. 8 is a diagrammatic representation of a horizontal directional drill attached to a drill string with a drill bit at an underground position.

With reference to FIG. 8, the present invention relates to an improved system for the makeup and breakout of pipe segments 12 using a horizontal directional drill 10. A horizontal directional drill 10 bores a hole by rotating and advancing a drill string 14 made up of pipe segments 12, which are generally elongate objects joined together in end-to-end arrangement. One end of the drill string 14 is attached at the drill 10, while the other end supports a drill bit 16. The drill bit 16 opens a borehole 18. As the drill bit 16 advances, new segments 12 of drill pipe are added to the drill string 14 by "making up" a new segment 12, lengthening the existing drill string. Conversely, when the drill string 14 is removed from a borehole 18, pipe segments 12 are "broken out" from the drill string.

During makeup of a drill string 14, techniques and systems may be used to assist makeup between adjacent pipe segments 12. The primary reason for implementing assisted makeup is to reduce or eliminate damage to the threads on the drill pipe segments 12 induced by the operator. This is especially imperative for inexperienced drill operators. An example of a mechanical assisted makeup system is described in U.S. Pat. No. 7,011,166, the contents of which are incorporated herein by reference.

With reference now to FIGS. 1-5, the horizontal directional drill 10 comprises a frame 20. Supported on the frame 20 are a drill assembly 22, engine compartment 23, pipe handling assembly 24, and an operator control station 26.

Figure 1:
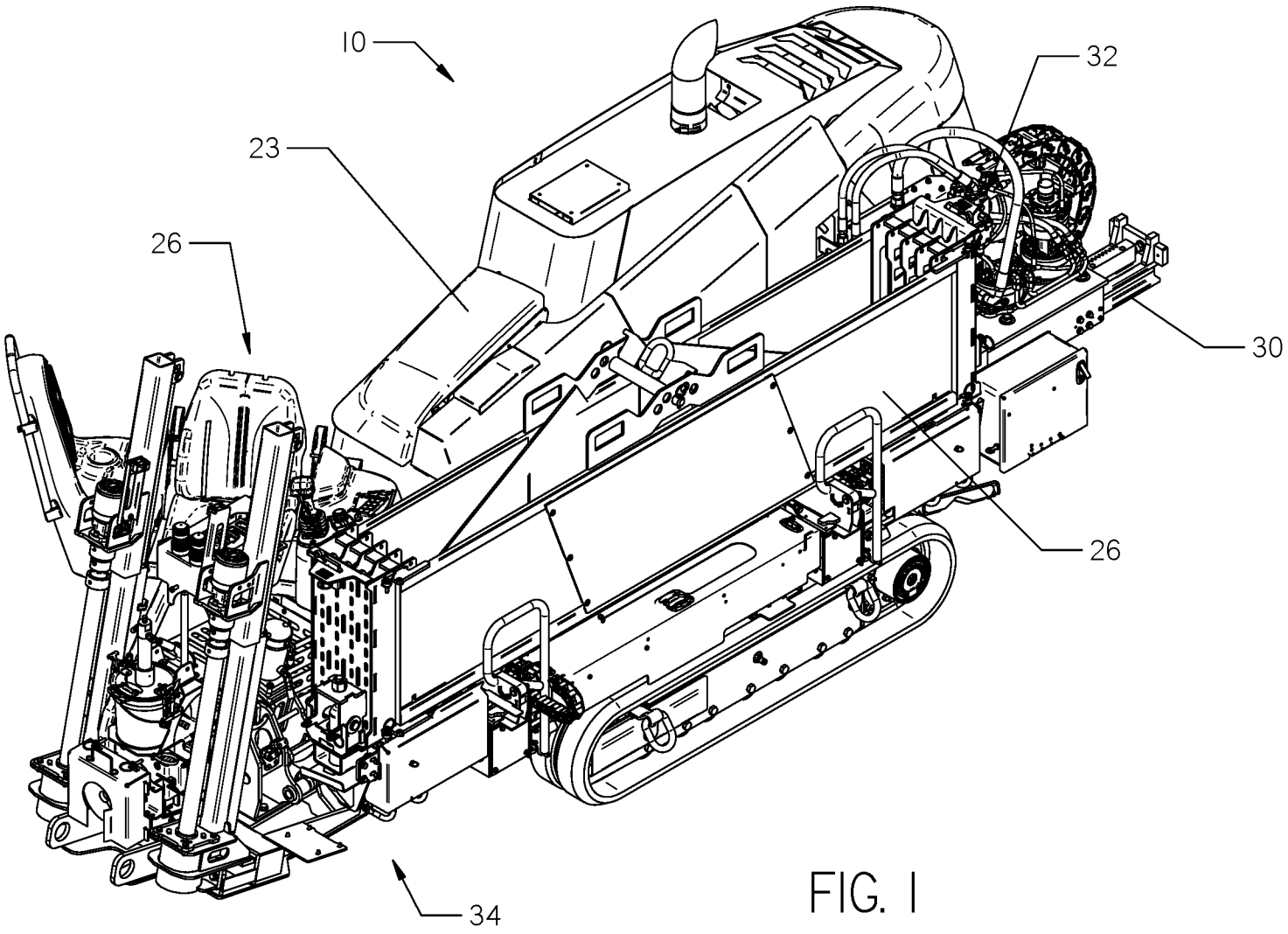
FIG. 1 is a side view of a horizontal directional drill.
Figure 2:
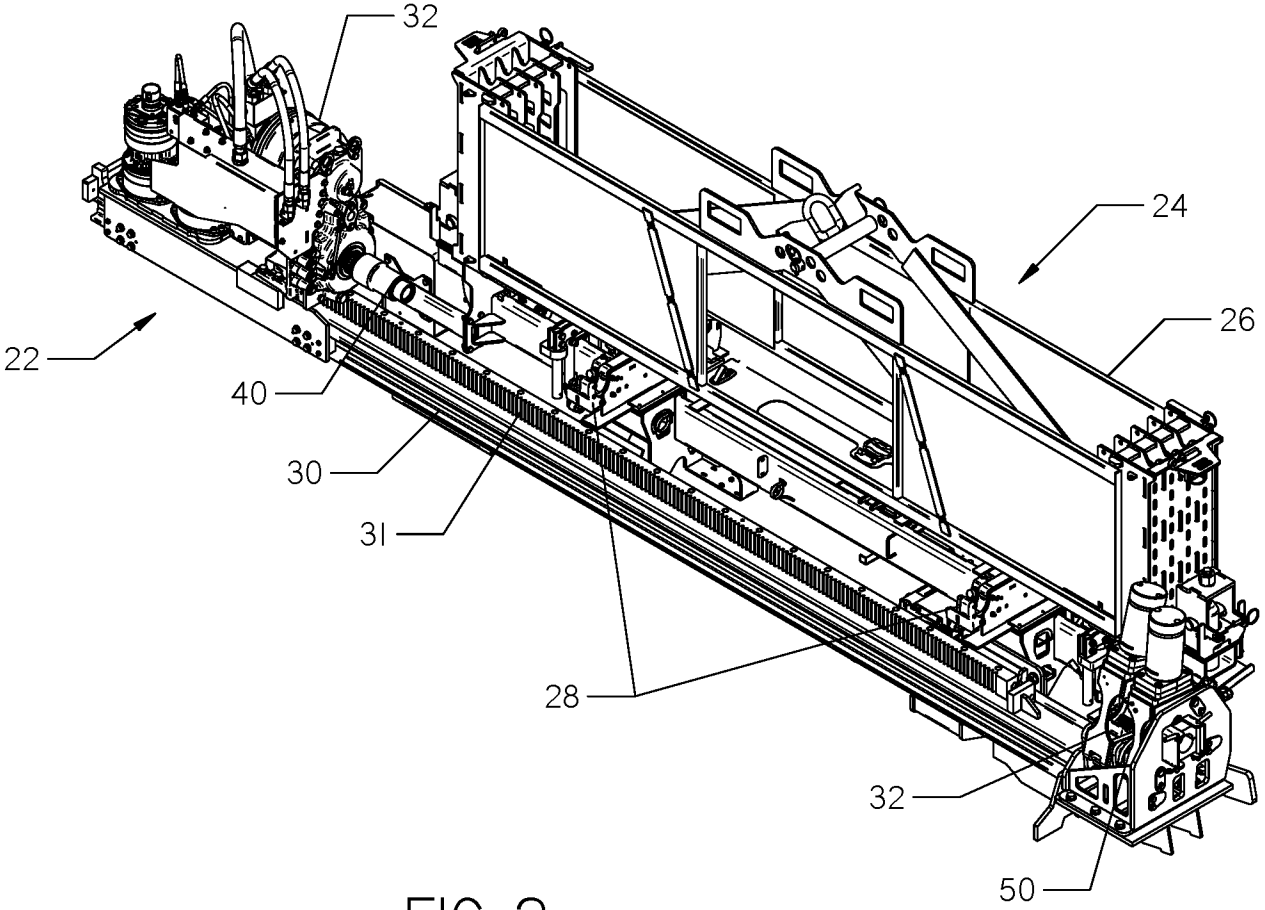
FIG. 2 is a perspective view of the drive assembly and pipe handling assembly of FIG. 1, removed from the frame of the horizontal directional drill.

FIG. 2 shows the drill assembly 22 and pipe handling assembly 24 removed from the frame 20 of FIG. 1. The pipe handling assembly comprises a pipe box 26 and a shuttle 28. The shuttle 28 transports pipe segments 12 (FIG. 8) between the pipe box 26 and the drill assembly 22.

Figure 4:
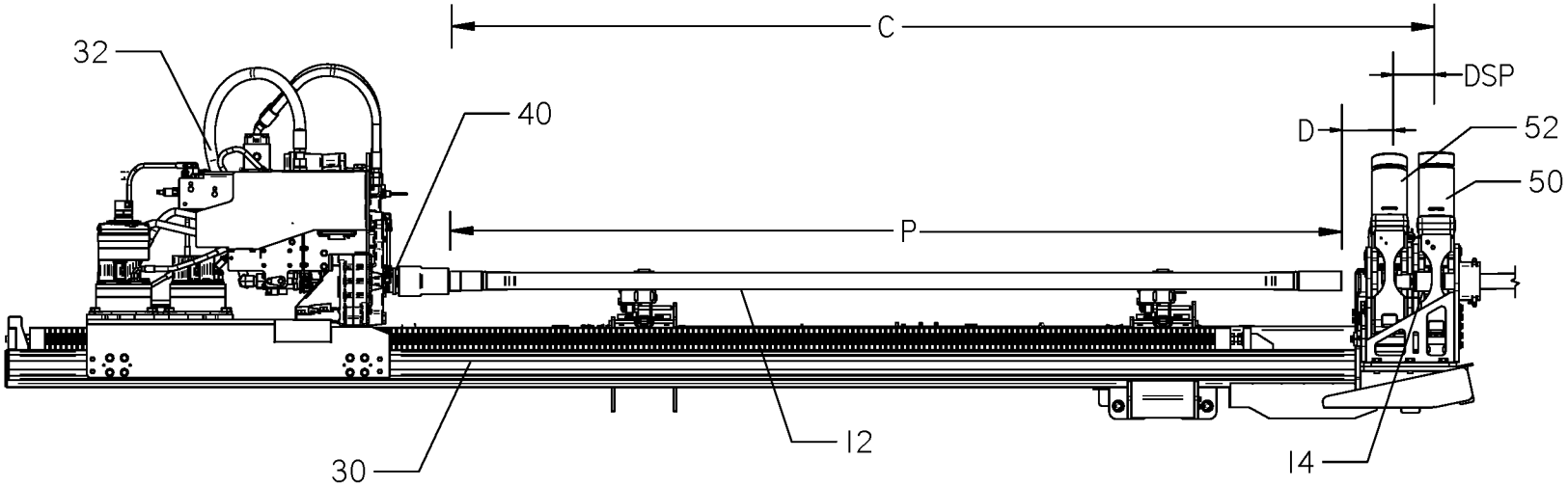
FIG. 4 is the side view of the drive assembly and shuttle of FIG. 2 with a pipe joint attached to the spindle.

The drill assembly 22 comprises a rail 30, a carriage 32, and a wrench assembly 34. The carriage 32 travels longitudinally on the rail 30. As shown, the carriage 32 is translated by a rack-and-pinion 31 drive, though other translation mechanisms may exist. A spindle 40 is disposed on the carriage, and configured for attachment to a pipe segment 12 held in the shuttle 28 (FIG. 4). A carriage encoder or position sensor tracks the position and speed of the carriage 32 in relation to the rail 30.

Figure 10:
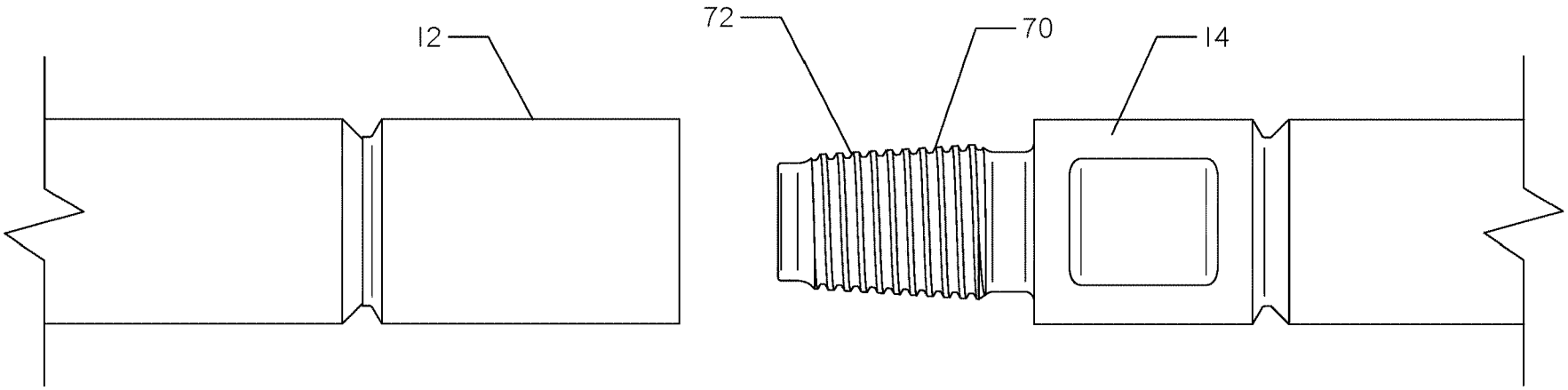
FIG. 10 is a side view of adjacent threaded ends of pipe segments, such as those used on a pipe segment and drill string in the system of the above Figures.

The spindle 40 rotates to connect and disconnect pipe joints to and from the drill string 14 by holding and rotating pipe segments 12 clockwise and counterclockwise. A rotation encoder tracks the spindle rotation speed and direction. The spindle 40 may also comprise a sensor to detect rotation torque. In FIG. 10, a pipe segment 12 is shown in position, ready to be made up with an adjacent, proximate drill pipe 14. The drill pipe 14 has a threaded male end 70 with threads 72 that correspond to internally-disposed lands within the female end of the pipe segment 12.

In this disclosure, the phrase "threads" refers both to the threads 72 on a male end, and corresponding, complementary threads within the female end of a pipe segment 12. In addition, while the "male end" is shown as being "uphole" in the configuration of the figures, an opposite configuration is possible, with a male end on the pipe segment 12 and female end on the drill string 14.

Figure 3:
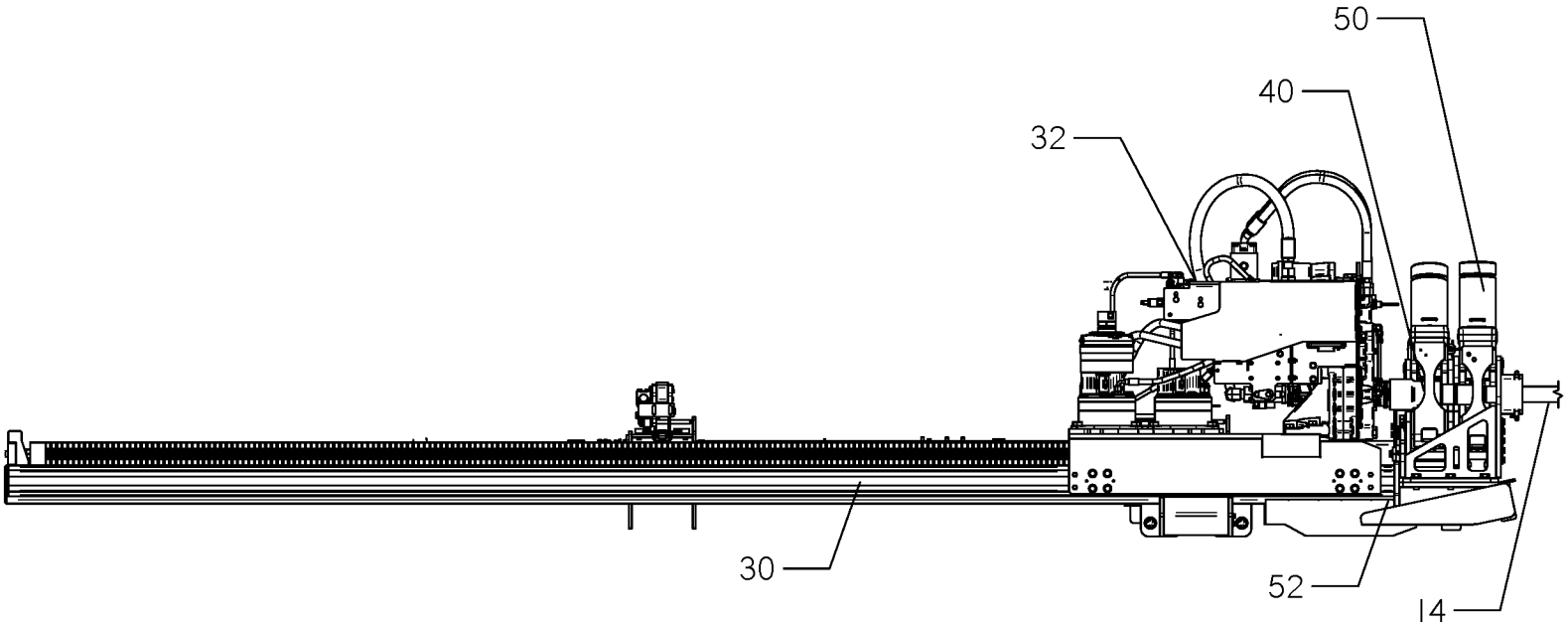
FIG. 3 is a side view of the drive assembly and pipe handling assembly of FIG. 2 with the carriage at the second end of the rail.

The wrench assembly 34 preferably comprises a first wrench 50 and a second wrench 52. As shown, the first wrench 50 is downhole from the second wrench 52. The first wrench 50 is preferably stationary. The first wrench is used to secure the longitudinal and rotational position of the drill string 14, as best shown in FIGS. 3-4. The second wrench 52 rotates about the center axis of the spindle 40. During makeup of a pipe segment 12 to a drill string 14, the first wrench 50 holds the drill string 14 in place while the spindle 40 attaches a pipe segment 12 through rotation. In common applications, such makeup rotation is clockwise.

The wrenches 50, 52 are then released and the drill string 14 may then be advanced through thrust provided by the carriage 32 and rotation provided by the spindle 40. When the carriage 32 is fully advanced and near the end of the rail 30, the first wrench 50 closes on the pipe segment 12 (now in the same position as the end of the drill string 14 prior to advancing the carriage), the spindle 40 is disconnected from the pipe segment 12 through counterclockwise rotation, and the process may repeat with a new pipe segment.

During breakout, the spindle is attached to a pipe segment 12 to be removed. The second wrench 52 is used to initially loosen the threaded connection between the drill string 14 and pipe segment 12 being removed. The spindle 40 then disconnects the pipe segment 12 from the drill string by rotating while the first wrench 50 holds the drill string 14 in place. In common applications, such breakout rotation is counterclockwise.

A pressure sensor may be positioned on the first wrench 50 hydraulics to detect when the wrench is opened and closed. The pressure sensor may detect any amount of pressure, including a pressure spike that is typical of the wrench 50 closing on a pipe segment. A pressure sensor may also be used to detect a pressure spike on the second wrench.

Alternatively, the system may detect when the wrenches are opened and closed from the operator station. For example, the system may include a linear position sensor to detect whether or not each wrench 50, 52 is open or closed.

In addition, sensors may be used to determine the position of the first end of the drill string 14 in relation to the spindle 40. During makeup, the drill string 14 position can be calculated by using position data from the carriage 32 encoder in conjunction with a drill string 14 disconnect indicator. The carriage 32 encoder records the location of the spindle 40. The disconnect indicator detects when the spindle 40 is in the process of being disconnected from the drill string 14—i.e. when the latest cycle of advancing the drill string 14 is complete and a new pipe segment 12 must be added.

One method of detecting disconnection of the drill string 14 from spindle 40 is to record counterclockwise rotation of the spindle 40. In most applications, such rotation indicates the drill string 14 is positioned within the first wrench 50 and the carriage 32 is in position to disconnect the spindle 40 from the end of the pipe segment 12 most recently added. The drill string 14 position can now be determined in relation to the spindle 40 by recording the position of the carriage 32 at a point where the spindle 40 begins to rotate in a counterclockwise direction. Spindle torque may also be detected in the counterclockwise direction to verify that the pipe segment 12 is being disconnected.

Additionally, the disconnect indicator could detect when the first wrench 50 is closed via a pressure sensor or by recording a wrench close command from the operator station. Regardless of the disconnect indicator used, when the carriage 32 is disconnected, a new pipe segment 12 will be added. Thus, one "pin length" of a pipe segment 12 will subsequently be added to obtain the drill string 14 position for the next cycle.

Figure 5:
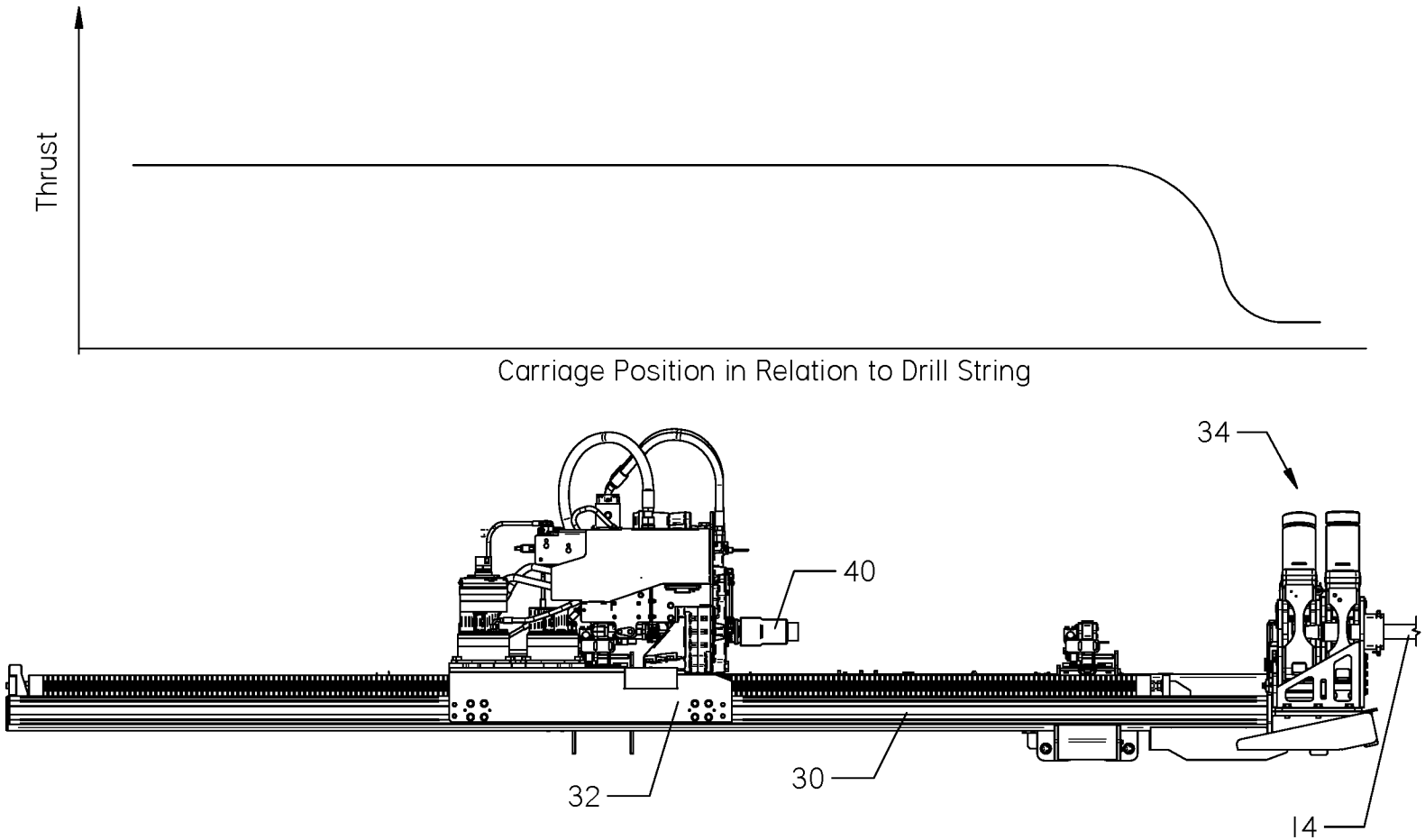
FIG. 5 is the side view of the drive assembly and shuttle of FIG. 2 with a chart showing carriage thrust in relation to carriage position.

In FIG. 5, the carriage 32 is retracted and attached to a new pipe segment 12, and prepared to attach the pipe segment to the drill string 14. The drill string 14 is held in the first wrench 50. With the drill string 14 position is known, the carriage 32 moves to the second end of the rail 30 as shown in FIG. 5. The shuttle 28 may then retrieve a pipe segment 12 from the pipe box 26 and position the joint in line with the spindle 40. The carriage 32 is thrust forward and the spindle 40 connected to the pipe segment 12.

As shown in FIG. 4, the distance (D) between the end of the pipe segment 12 opposite the spindle 40 and the drill string 14 position (DSP) is equal to the Carriage Position (C) minus the Pipe Joint Length (P) plus the drill string position (DSP). That is, C−(P+DSP)=D. A certain amount of error must be expected to account for variations in the number of threads exposed between the spindle 40 and the pipe segment 12. It is typical that a pipe segment 12 is not fully threaded onto the spindle 40 upon retrieval from the shuttle 28. However, when the spindle 40 is threading the pipe segment 12 to the drill string 14, this connection will become fully threaded, resulting in some error. With D known, the carriage 32 may thrust forward to makeup the pipe segment 12 to the drill string 14.

While backreaming, pipe segments 12 are removed, or "broken out" from the drill string 14. A similar process may be utilized to determine the drill string 14 position. The carriage 32 encoder records the location of the spindle 40 in conjunction with a second indicator. Rather than detecting the spindle 40 disconnecting from the drill string 14, the second indicator will detect a pipe segment 12 disconnecting from the drill string 14. The drill string position is determined by subtracting the length of the pipe segment 12 from the position of the carriage 32.

Each of these methods for detecting the carriage 32 position, or the readiness of the system for making up (or breaking out) segments of pipe, are in preparation for activation of a transition mode or pipe makeup mode. This transition mode will provide thrust adjustment to the system to avoid thrusting the carriage 32 too quickly or too slowly, and falling out of sync with the rotation of the spindle 40.

Figure 9:
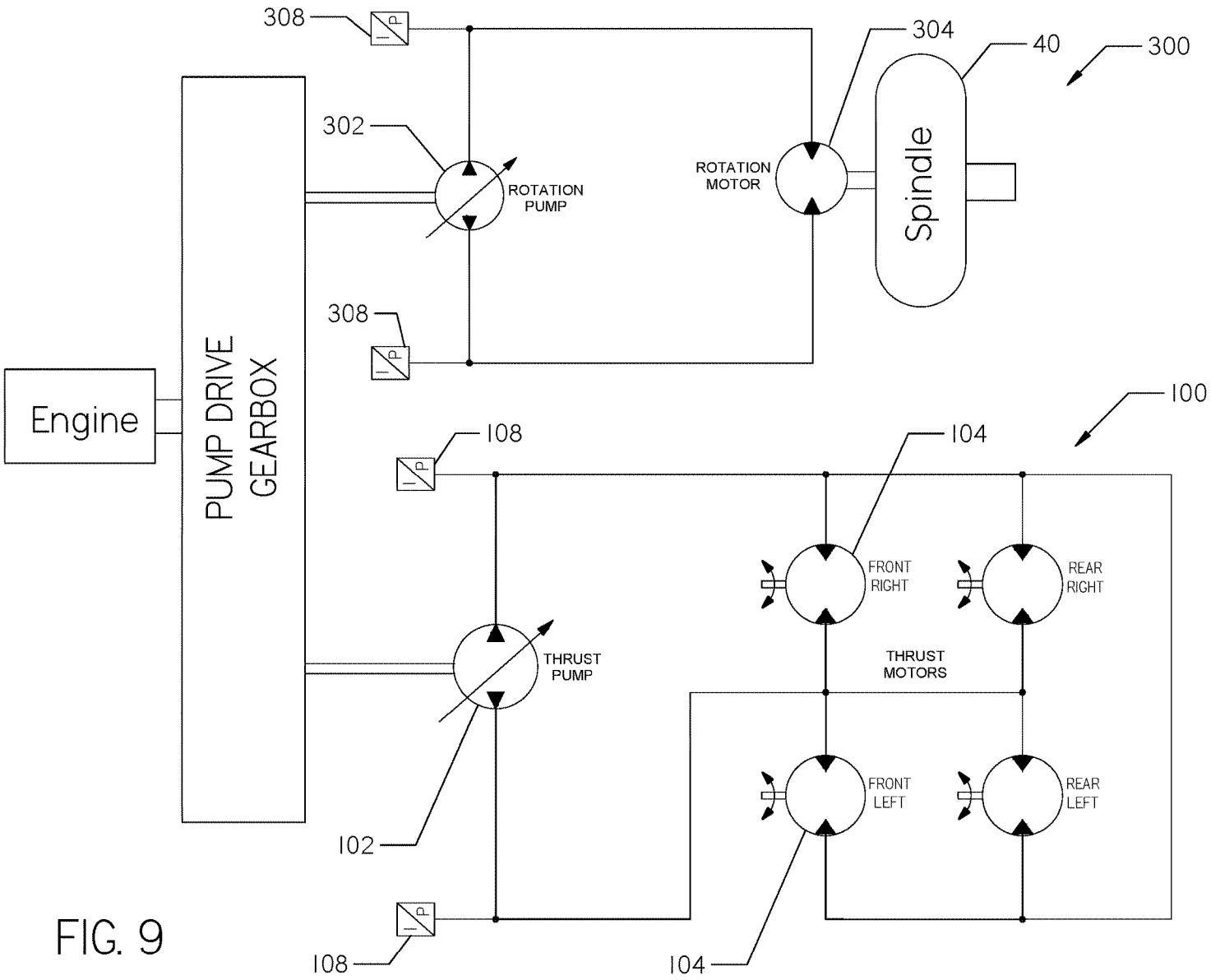
FIG. 9 is a diagrammatic representation of a hydraulic circuit with pressure transducers for monitoring pressure therein.

With reference to FIG. 9, a hydraulic thrust circuit 100 is shown. The circuit 100 comprises a hydraulic thrust pump 102 and one or more hydraulic motors 104 provide thrust to propel the carriage 32 along the rail 30. The hydraulic pump 102 may be housed within the engine compartment 23 (FIG. 1) and the hydraulic motors 104 are positioned on the carriage 32. As shown, there are four motors 104.

The rate of fluid flow from the hydraulic pump 102 controls the carriage speed, but the fluid pressure indicates the thrust force of the carriage 32. The fluid pressure may be read and verified by one or more pressure transducers or sensors 108. Preferably, at least one sensor 108 is on each side of the thrust pump 102, such that deviations from ideal fluid pressure may be detected due to too much, or too little thrust.

Pressure may be reduced or increased by including a valve (not shown) within the circuit 100 to increase or decrease fluid flow to the motors 104. Alternatively, the pump 102 may increase or decrease its power and/or operating characteristics to increase or decrease flow in response to pressure, as recorded by the transducers 108.

Excessive or insufficient thrust force during makeup and breakout of a drill string 14 may cause damage to pipe threads. For example, if insufficient thrust is provided, rotation of the spindle 40 during makeup may result in damage to the threads do to failure of the spindle to advance properly. Similarly, excessive thrust may result in excessive load being provided to the threads due to the spindle 40 being advanced too much.

As a result, it is advantageous to limit the hydraulic thrust within a defined transition zone. For the purposes of this application, this is referred to as a transition zone or a pipe makeup zone. When the carriage 32 is outside of the pipe makeup zone, thrust and speed will be allowed to operate at full or near full capacity, as illustrated in FIG. 5. However, the carriage 32 will automatically reduce thrust force within the pipe makeup zone. The pipe makeup zone can be determined in several ways. For example, when the drill string 14 position is known (as described above), a pipe makeup zone can be set.

Figure 6:
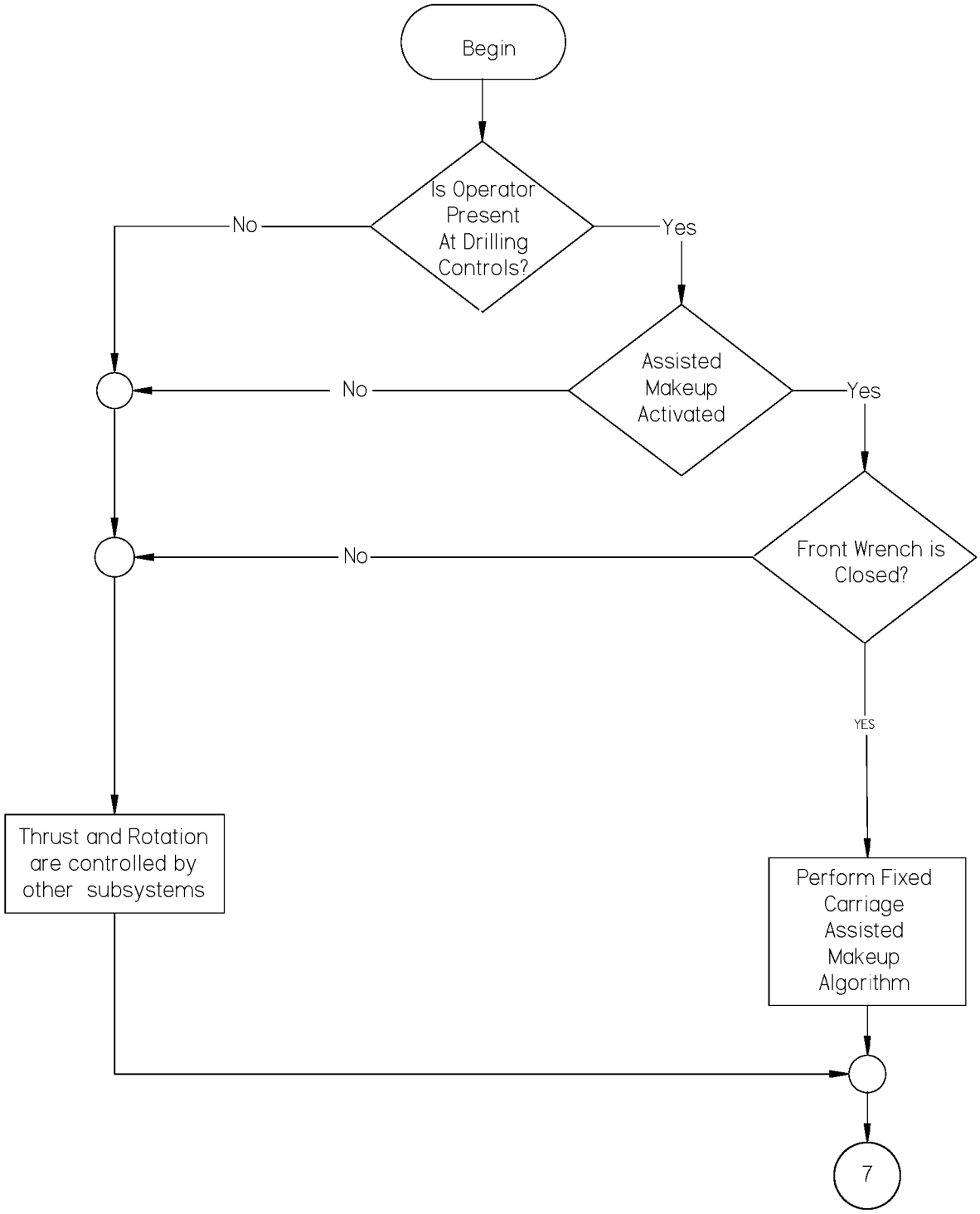
FIG. 6 is a flow chart embodying the general operation of the drill.

With reference to FIG. 6, the general operation of the drill 10 is shown. An assisted makeup algorithm is utilized to control the thrust of the carriage 32 only when an operator is present at the drilling controls, activated makeup is activated, placing the drill 10 in transition mode, and the front wrench 50 is closed. The first wrench 50 must be closed to ensure that the drill string 14 is ready for makeup or breakout, rather than ordinary drilling operations.

Figure 7:
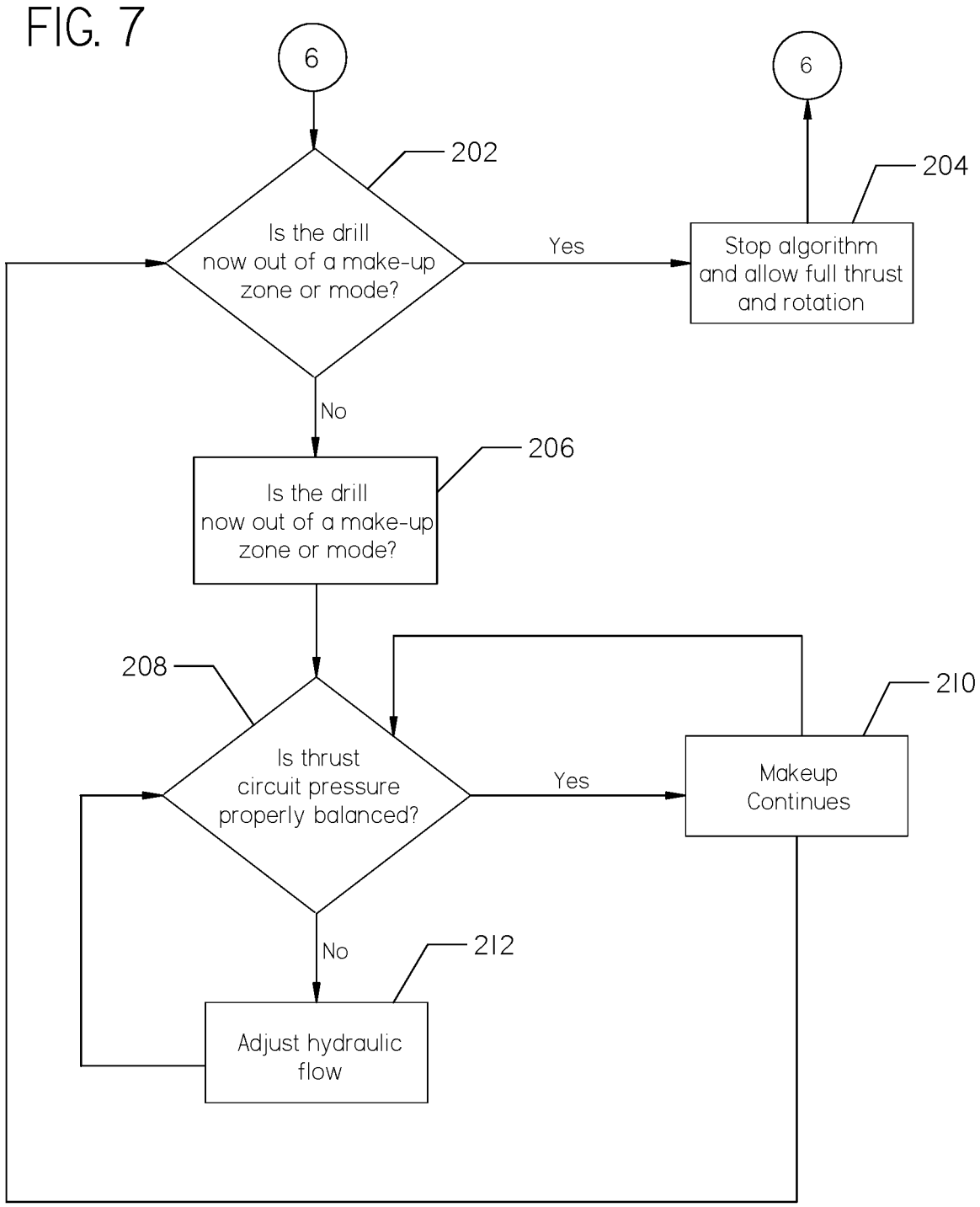
FIG. 7 is a flow chart of the makeup logic when the drill is in a transition or pipe makeup mode.

With reference to FIG. 7, activated makeup logic of the transition mode (as defined in FIG. 6) is shown in more detail. Sensors are used to determine whether the carriage 32 is in the pipe makeup zone or pipe makeup mode at 202. If not, full thrust and rotation are allowed at 204 and operation continues. If so, rotation and thrust may be slowed or otherwise coupled at 206. It may be advantageous to coordinate rotation and thrust such that they match a thread pitch. The thrust pressure sensor 108 is monitored to determine that pressure is properly balanced at 208. If so, makeup operations continue at 210 and the process ends when makeup is concluded. If not, flow is reduced by the thrust pump 102 if the pressure sensors 108 indicate that reduction is needed, or, in the alternative, flow is increased by the thrust pump 102 if the pressure sensors 108 indicate that more flow is needed at 212 until the condition of step 208 is met.

Thrust pressure feedback is used to limit the thrust applied by the carriage 32 when the carriage is operating in the pipe makeup zone or in pipe makeup mode. It should be understood that when a pipe segment 12 is attached to the carriage 32 for makeup purposes, the carriage may be in the pipe makeup zone even when relatively far from the pipe string 14, as shown in FIG. 4. Alternatively, pipe makeup mode may be actuated by a switch, or automatically upon closing the front wrench 50. As a further alternative, both the position of the front wrench 50 and the location of the carriage 32 may be used to provide redundancy in the system.

FIG. 5 illustrates the relative thrust provided to the carriage 32 as compared to the distance from the drill string 14, as utilized in a backreaming, or breakout operation. The speed and force may be gradually limited as the spindle 40 and carriage 32 approach the drill string 14. As the spindle 40 is rotated, the carriage 32 thrust and spindle rotation are coordinated so that carriage 32 thrust will not exceed or fall below what is necessary to thread the pipe joint onto the spindle. Because carriage 32 thrust is reduced, the force exerted on the pipe joint threads will not be allowed to exceed that which will "smoke" or cause damage to the threads. Likewise, thrust is limited in the reverse direction when disconnecting the spindle 40 from the drill string 14. Reverse thrust force and speed will not be allowed to exceed the counterclockwise rotation of the spindle 40, and the thrust limiter will prevent the thrust pressure from exceeding the predetermined threshold.

During a Horizontal Directional Drilling (HDD) operation there are times when the drill string position will not be known or the spindle is connecting to a pipe segment 12 that is not attached to the drill string. In this case, the makeup zones may be predetermined based on where the pipe joint and drill string are typically located. Alternatively, if the machine is actively controlled by an operator, the drill 10 may be placed into the assisted makeup mode as initiated by clockwise rotation of the spindle 40. When the operator begins clockwise rotation, the system assumes that the spindle 40 is near a pipe segment 12 and makeup is about to begin. Thrust is automatically reduced to match the rotation speed of the spindle, and pressure feedback is monitored.

The current system is reliant on controlling the thrust force of the spindle 40. As a result, it may be necessary to account for additional force placed on a pipe segment 12 resulting from the weight of the carriage 32. During an HDD operation the angle of the drill 10 may be modified to varying inclines depending on the terrain and job parameters. An inclinometer (not shown) may be placed on the drilling assembly, preferably the carriage 32. The inclinometer can be used to determine the amount of increase force placed on a pipe segment 12 resulting from the weight of the carriage 32 in relation to the angle of the rail 30 on which it sits. Alternatively, the angle of the carriage 32 can be assumed based on normal operating conditions.

While thrust limitation is considered herein, FIG. 9 discloses hydraulic rotation circuit 300. The circuit 300 comprises a rotation pump 302 which powers a rotation motor 304. The rotation motor 304 rotates the spindle 40, imparting rotation to the spindle for makeup and breakout, and to the drill bit 16 (through the drill string 14) for drilling purposes. Pressure transducers 308 are disposed on each side of the pump 302 and may be monitored for unexpected fluctuations in hydraulic fluid pressure. While thrust adjustment is the preferred way of avoiding smoking of threads when the drill 10 is in a pipe makeup mode, it should be understood that rotation adjustment through manipulation of the rotation circuit 300 provides an alternative method.

The above system could be implemented in multiple embodiments with varying degrees of automation. It would be possible to implement fully automated makeup and breakout with the current system.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed. Changes may be made in the construction, operation and arrangement of the various parts, elements, steps and procedures described herein without departing from the spirit and scope of the invention as described in the following claims.

The invention claimed is:

1. A method of attaching a threaded pipe segment to a drill string having a first end, the method comprising:

using at least one motor powered by a hydraulic circuit to apply thrust to the threaded pipe segment in the direction of the drill string;

closing a wrench assembly about the first end;

placing the circuit into a transition mode in response to closure of the wrench assembly, wherein the transition mode is characterized by:

monitoring pressure in the hydraulic circuit; and automatically altering the flow rate of fluid within the circuit in response to a change in the monitored circuit pressure.

2. The method of claim 1 in which the pipe segment has a threaded end and in which the circuit is put into a transition mode after the threaded end is within a predetermined distance from the drill string.

3. The method of claim 1 further comprising:

opening the wrench assembly; and taking the circuit out of transition mode in response to opening of the wrench assembly.

4. The method of claim 3 further comprising:

after taking the circuit out of transition mode, using the at least one motor to thrust the threaded pipe segment toward an underground environment.

5. The method of claim 4 further comprising:

after thrusting the pipe segment, closing the wrench assembly; and putting the circuit into transition mode in response to closure of the wrench assembly.

6. The method of claim 1 further comprising:

concurrently with the step of thrusting the threaded pipe segment, causing the threaded pipe segment to rotate.

7. A method of handling first and second elongate objects, the first object comprising a tubular pipe segment having a first end, and the second object comprising a drill string formed from a plurality of identical tubular pipe segments disposed in end-to-end relationship, at least a portion of the drill string being situated within an underground environment, the drill string having a second end having a shape complementary to the first end of the first object, the method comprising:

rotating the first object relative to the second object;

using at least one motor powered by a hydraulic circuit to move the first object longitudinally toward the second object;

as the first object moves longitudinally toward the second object, monitoring pressure within the hydraulic circuit;

adjusting the rate of fluid flow within the circuit in response to a change in the monitored hydraulic pressure;

joining the first end of the first object to the second end of the second object;

thereafter, advancing joined first and second objects toward an underground region;

in which the rate of fluid flow is not adjusted in response to changes in hydraulic pressure within the hydraulic circuit while the joined first and second objects are advanced.

8. The method of claim 7 in which the rate of fluid flow is decreased in response to a change in the hydraulic pressure.

9. The method of claim 7 in which the rate of fluid flow in increased in response to a change in the hydraulic pressure.

10. The method of claim 7 further comprising:

prior to the steps of rotating and moving the first object, engaging the second object adjacent its second end with a wrench.

11. The method of claim 7 in which the first object is joined to a rotatable spindle supported by a movable carriage.

12. The method of claim 7, comprising:

prior to monitoring the pressure, determining whether the first and second objects are within a predetermined distance; and performing the monitoring step in response to a determination that the first and second objects are within the predetermined distance.

13. A method comprising:

providing hydraulic fluid to a motor via a hydraulic circuit;

powering longitudinal movement of a tubular pipe segment with the motor;

determining the position of the pipe segment relative to the drill string;

putting the circuit into a reduced-flow mode whenever the tubular pipe segment is within a predetermined distance from the drill string;

thereafter, monitoring the pressure of the hydraulic fluid within the hydraulic circuit;

rotating the tubular pipe segment; and adjusting a rate of flow of hydraulic fluid to the motor when the monitored pressure meets or exceeds a predetermined threshold.

14. The method of claim 13 in which the tubular pipe segment has opposed threaded ends, and further comprising:

joining a threaded end of the threaded pipe segment to a mating threaded end of a drill string.

15. The method of claim 14 in which the step of determining the position of the pipe segment relative to the drill string comprises:

determining whether a wrench assembly is closed about the drill string.

16. A method of using a system, the system comprising:

a tubular pipe segment;

a motor configured to power either translational or rotational movement of the pipe segment as it advances towards a drill string; and a hydraulic circuit within which the motor is disposed and within which fluid flows, the method comprising:

determining the position of the pipe segment relative to the drill string;

putting the circuit into a reduced-flow mode whenever the tubular pipe segment is within a predetermined distance from the drill string;

causing fluid to flow around the hydraulic circuit and through the motor;

monitoring the hydraulic circuit for a pressure differential between opposite sides of the motor; and in response to a pressure differential, automatically adjusting the flow rate of fluid within the hydraulic circuit.

17. The method of claim 16 in which fluid flow through the motor causes translation or rotation of the pipe segment.

18. The method of claim 16 in which the system further comprises:

a drill string formed from a plurality of tubular pipe segments arranged in end-to-end engagement;

and in which the method further comprises:

while monitoring the hydraulic circuit, joining the pipe segment to the drill string.

* * * * *